US008256178B2

(12) United States Patent
Sarrablo Moreno

(10) Patent No.: US 8,256,178 B2
(45) Date of Patent: Sep. 4, 2012

(54) FLEXIBLE BRICK PLATE FOR BUILDING ARCHITECTURAL ELEMENTS, AND METHOD FOR MANUFACTURING SAID PLATE

(75) Inventor: Vicente Sarrablo Moreno, Castelldefels (ES)

(73) Assignee: Flexbrick, S.L., Barcelona (ES)

( * ) Notice: Subject to any disclaimer, the term of this patent is extended or adjusted under 35 U.S.C. 154(b) by 42 days.

(21) Appl. No.: 12/599,572

(22) PCT Filed: Apr. 30, 2008

(86) PCT No.: PCT/ES2008/000295

§ 371 (c)(1),
(2), (4) Date: Aug. 31, 2010

(87) PCT Pub. No.: WO2008/139008

PCT Pub. Date: Nov. 20, 2008

(65) Prior Publication Data

US 2011/0047914 A1 Mar. 3, 2011

(30) Foreign Application Priority Data

May 10, 2007 (ES) ..... 200701342
Dec. 20, 2007 (ES) ..... 200703379

(51) Int. Cl.
*E04F 13/08* (2006.01)

(52) U.S. Cl. ..... 52/388; 52/389

(58) Field of Classification Search ..... 52/388, 52/389, 81.2, 86, 88, 81.6, 231, 223.7, 323; 404/34–36, 43
See application file for complete search history.

(56) References Cited

U.S. PATENT DOCUMENTS 1,994,644 A * 3/1935 Harshberger ..... 52/388
4,152,875 A 5/1979 Soland

FOREIGN PATENT DOCUMENTS

EP 0 301 487 A2 2/1989
GB 2 139 676 A 11/1984
WO WO 00/71823 A1 11/2000

OTHER PUBLICATIONS

International Search Report for PCT International Application No. PCT/ES2008/000295 mailed Sep. 29, 2008.

* cited by examiner

*Primary Examiner* — Brian Glessner
*Assistant Examiner* — Paola Agudelo
(74) *Attorney, Agent, or Firm* — RatnerPrestia

(57) ABSTRACT

A flexible brick plate including a plurality of flexible interwoven rods forming a mesh, and a plurality of bricks provided with fastening shapes coupled to at least some of the rods in order to retain the bricks in the mesh. Optionally, the plate is designed to be placed with one side thereof against a formwork and to receive a binding agent from and on the other side thereof. The manufacturing method includes crossing and interweaving warp rods and weft rods to form a mesh, arranging at the same time rows of bricks in the mesh between the weft rods, and coupling fastening shapes formed in the bricks with at least some of the warp or weft rods.

18 Claims, 6 Drawing Sheets

FLEXIBLE BRICK PLATE FOR BUILDING ARCHITECTURAL ELEMENTS, AND METHOD FOR MANUFACTURING SAID PLATE

This application is a U.S. National Phase Application of PCT International Application No. PCT/ES2008/000295, filed Apr. 30, 2008.

TECHNICAL FIELD

The present invention relates to a flexible brick plate comprising a mesh of metal rods and a plurality of bricks retained in substantially stable positions in said mesh. The plate of the present invention is suitable, for example, for building concealed brick or bare brick architectural elements, arranging the flexible plate with one of its sides against a falsework and applying a binding agent from and on the other side of the plate. In an alternative embodiment, the brick plate is shaped to be used in applications that do not require a binding agent thereon. The present invention also relates to a method for the manufacture of said plate.

BACKGROUND OF THE INVENTION

International patent application WO 00/71823, belonging to the same inventor as the present invention, discloses a flexible brick plate and a method for building reinforced masonry vaulted roofs with the intrados finished using said flexible brick plate. The plate comprises a flexible sheet support provided with a plurality of holes, typically a sheet metal with cuts and expanded, known as "deployé", on which a plurality of bricks are fixed arranged on one of its larger faces and forming a mesh, with aligned gaps between the bricks. Transverse rigidizing and fastening elements are fixed, for example, by welding, at opposite ends of said sheet support. A plurality of first reinforcement bars are fixed at its ends, for example, by welding, to both of said rigidizing and fastening elements and arranged along said gaps between bricks. These first reinforcement bars are furthermore linked to a series of points of said sheet support by spacers also fixed by welding. The openings of the expanded sheet support allow the passage of concrete or mortar applied to one side of the flexible plate, and the sheet support acts as a permanent formwork which is integrated in the building. The method for building using this flexible brick plate provides for building vaulted roofs without needing to use falsework, so the flexible brick plate furthermore includes an impermeable flexible canvas, such as a plastic sheet, removably fixed on the bare brick face of the flexible brick plate, which must be removed once the mortar or concrete has set.

DESCRIPTION OF THE INVENTION

The present invention provides a flexible brick plate for building architectural elements which has a simple constitution and integrates a reduced number of different components.

The present invention also provides a method for manufacturing said flexible brick plate by means of a smaller number of relatively simple operations.

The flexible brick plate of international patent application WO 00/71823 has proven to be fully operative. However, it has some aspects that can be improved. For example, in the working position, the expanded sheet support is covering the bricks and the reinforcement bars and the concrete or mortar must penetrate through the openings of the expanded sheet support to fill the gaps between the bricks and around the reinforcement bars. The small dimension of the openings of the expanded sheet support obstructs the penetration of the concrete or mortar and slows and obstructs the operation for applying the binding agent. In addition, the constitution of this flexible brick plate is relatively complex and many different components and relatively laborious operations, such as multiple welds, are necessary for the manufacture thereof increasing the final price of the product.

According to a first aspect, the present invention provides a flexible brick plate for building architectural elements. Said flexible plate comprises a plurality of flexible interwoven rods forming a mesh, and a plurality of bricks provided with fastening shapes coupled to at least some of said rods in order to retain said bricks arranged on one of its larger faces in said mesh. To build an architectural element, whether a roof, a floor, a wall, or any other planar or arched structure, using the flexible brick plate of the present invention, the flexible brick plate is placed with one of its sides against a falsework and a binding agent, such as concrete or mortar, is applied from and on the other one of its sides. When the binding agent has set, the falsework is removed and the bricks are seen on the first side of the architectural element obtained.

Advantageously, said rods are corrugated rods, such that the intersection points of the rods in the mesh are immobilized by the superposition of peaks and valleys of the corrugations. The bricks are substantially rectangular and said fastening shapes comprise channels formed in first opposite edges of each brick to receive therein mutually parallel support rods forming part of said plurality of interwoven rods. Thus, the support rods retain the bricks and immobilize them against movements in a first direction perpendicular to the support rods. The support rods are crossed and interwoven with mutually parallel positioning rods forming part of said plurality of interwoven rods. These positioning rods are perpendicular to the support rods and are shaped and arranged to maintain the support rods in suitable positions in order to retain the bricks in the mesh leaving a first gap between said first opposite edges of adjacent bricks. Furthermore, the positioning rods are arranged adjacent to second opposite edges of each brick, perpendicular to said first edges, to immobilize the bricks against movements in a second direction parallel to the support rods. Finally, at least one reinforcement rod forming part of said plurality of interwoven rods is arranged in each of said first gaps between the first opposite edges of the adjacent bricks. The reinforcement rods are parallel to the support rods and are crossed and interwoven with the positioning rods.

The material of the support, positioning and reinforcement rods is flexible and elastic enough to allow winding the plate up in a roll substantially without causing any plastic or permanent deformation of the rods, i.e., such that the roll can be again unrolled to extend the flexible brick plate without any negative effect on the rods. The capacity of the flexible brick plates of the present invention for being wound up in a roll greatly facilitates the storage, transport and handling thereof, and eliminates many of the size limitations imposed by road transport regulations existing with the plate of the prior art. A suitable material for the rods is steel, and the bricks can be, for example, of a rigid material, such as cooked clay, stone, concrete, reinforced concrete, plastic, wood, glass, or a metal, such as aluminum. Furthermore, the bricks are shaped so that they can be produced according to a classic extrusion method well known in the art. Obviously, to facilitate winding it up in a roll, the longest dimension of the bricks will be arranged parallel to the axis of the roll and perpendicular to the support and reinforcement rods.

In the working position, the rods are arranged between the bricks and coupled thereto and there is no impediment for applying the binding agent on the bricks and inside the gaps between them in order to fill all the gaps and surround and cover the rods. It must be taken into account, in fact, that in an architectural element built using the flexible brick plate of the present invention all the rods will act to a certain extent as reinforcements, i.e., as resistant and rigidizing elements in cooperation with the binding agent. However, only the rods arranged in the first gaps between bricks, herein referred to as "reinforcement rods", are separated enough from the bricks to assure that they will be completely embedded in the binding agent, i.e., completely surrounded and covered by the binding agent, concrete or mortar, such that they act as classic reinforcement bars. For this reason, it is recommended to take into account only these "reinforcement rods" when performing the strength calculations for the architectural element.

According to an alternative embodiment, the brick plate is also suitable for a large number of applications that do not use a binding agent, i.e., leaving the rods and the bricks in the open air, with minimal adaptations. Among these applications that do not use a binding agent the following can be mentioned by way of example: covering for grounds and terrains, for example, for building roads on the sand on beaches and the like, or for providing walkable surfaces on the ground, allowing grass to grow in the gaps between the bricks; surface applications for walls, whether indoor or outdoor, as a finishing; outer covering for flat or inclined roofs or vaults ballasting their waterproofing elements; forming ventilated walls, lattices, pergolas, shaded area roofs and/or walls, etc., to partially prevent or attenuate the passage of the light, allowing air to pass; among others.

The adaptations necessary to do so consist of making both the rods and the bricks from materials resistant to external agents or from materials provided with a treatment resistant to external agents. Furthermore, for applications that do not use a binding agent, the brick plate does not need the reinforcement rods described in the previous embodiment, so they can be left out with the subsequent economic savings, although it must be indicated that the presence of the reinforcement rods neither prevents nor hinders the use of the brick plate in applications that do not use a binding agent.

The following can be mentioned as materials suitable for the support rods and positioning rods: stainless steel; galvanized steel, painted steel; plasticized steel; aluminum; plastic material, i.e., synthetic polymer material; and plastic material reinforced with fibers such as glass fiber, carbon fiber, steel cables, nylon threads or the like, among others.

The bricks can have different shapes in addition to the typical orthohedron shape. Generally, in order to be inscribed and retained in the rectangle formed between two support rods and two positioning rods crossed in the mesh, each brick has two substantially parallel opposite larger faces, at least one of which can be smooth or have embossments, furrows, hollows, protuberances, etc., first opposite edges, substantially parallel to one another, in which channel-shaped fastening shapes are formed to receive inserted therein the support rods, and second opposite edges shaped to cooperate with the positioning rods, for example, being adjacent or in contact therewith, in order to retain the bricks in the mesh preventing them from sliding along the support rods. Said first edges can be rectilinear or interrupted, provided that each one has a rectilinear portion or several aligned rectilinear portions provided with the fastening shape. The second edges do not necessarily have to be rectilinear or parallel to one another or perpendicular to the first edges, being able to have a variety of shapes provided that they meet said function of cooperating with the positioning rods. Depending on the distances between the bricks in the mesh, bevels are formed in the converging edge between one of the larger faces and the first edges, which bevels have the function of preventing the edges of adjacent bricks in the mesh from colliding with one another when the flexible plate is wound up in a roll.

Whatever the bricks are like, the plate can comprise only the number of support and positioning rods strictly necessary for supporting and positioning the bricks and keeping the mesh well secured, or it can comprise a number of additional rods parallel to the support rods and/or a number of additional rods parallel to the positioning rods.

According to a second aspect, the present invention provides a method for manufacturing a flexible brick plate for building architectural elements analogous to the one described above, which is suitable for being placed with one of its sides against a falsework and receiving a binding agent from and on the other one of its sides. The method firstly comprises arranging a first plurality of mutually parallel rods to form a warp. Then a second plurality of rods is crossed and interweaved consecutively with said first plurality of rods to form a mesh weft, and consecutively arranging rows of bricks in said mesh between the rods of said second plurality of rods, coupling fastening shapes formed in said bricks with at least some of the rods of the first and/or second plurality of rods.

Preferably, the method of the present invention comprises the prior step of corrugating the rods to be used for the first and second plurality of rods, and during the interweaving operation, alternately arranging peaks of corrugations existing in the rods of the first plurality of rods on valleys of corrugations existing in the rods of the second plurality of rods, and vice versa, to immobilize the intersection points of the rods forming the warp and the weft in the mesh. This technique of forming a grid by means of corrugated rods has been known for many years and is part of the public domain. The novelty consists of consecutively coupling rows of bricks in the mesh alternated with the rods of the second plurality of rods as they are being placed to form the weft, for the purpose of retaining the bricks in stable positions in the mesh.

The method furthermore comprises arranging support rods, forming part of the first plurality of rods of the warp, at suitable distances for coupling them with said fastening shapes, which are formed in first opposite edges of the bricks, and for providing a first gap between said first edges of adjacent bricks. The method also furthermore comprises arranging reinforcement rods, forming part of the first plurality of rods of the warp, in suitable positions between said support rods to be arranged inside said first gaps and at a distance from the first opposite edges of adjacent bricks. The method comprises crossing and interweaving positioning rods forming part of the second plurality of rods of the weft, before and after arranging each row of bricks, in suitable positions for providing a second gap between second opposite edges of adjacent bricks, said second edges being perpendicular to the first edges.

With this method, the flexible brick plate of the present invention can be manufactured using a smaller number of components, only rods and bricks, and without needing welding or gluing operations or the like, so the flexible brick plate of the present invention can be made at a lower cost in comparison to the plate of the prior art.

BRIEF DESCRIPTION OF THE DRAWINGS

The previous and other features and advantages will be better understood from the following detailed description of an exemplary embodiment with reference to the attached drawings, in which.

DETAILED DESCRIPTION OF AN EXEMPLARY EMBODIMENT

Figure 1:
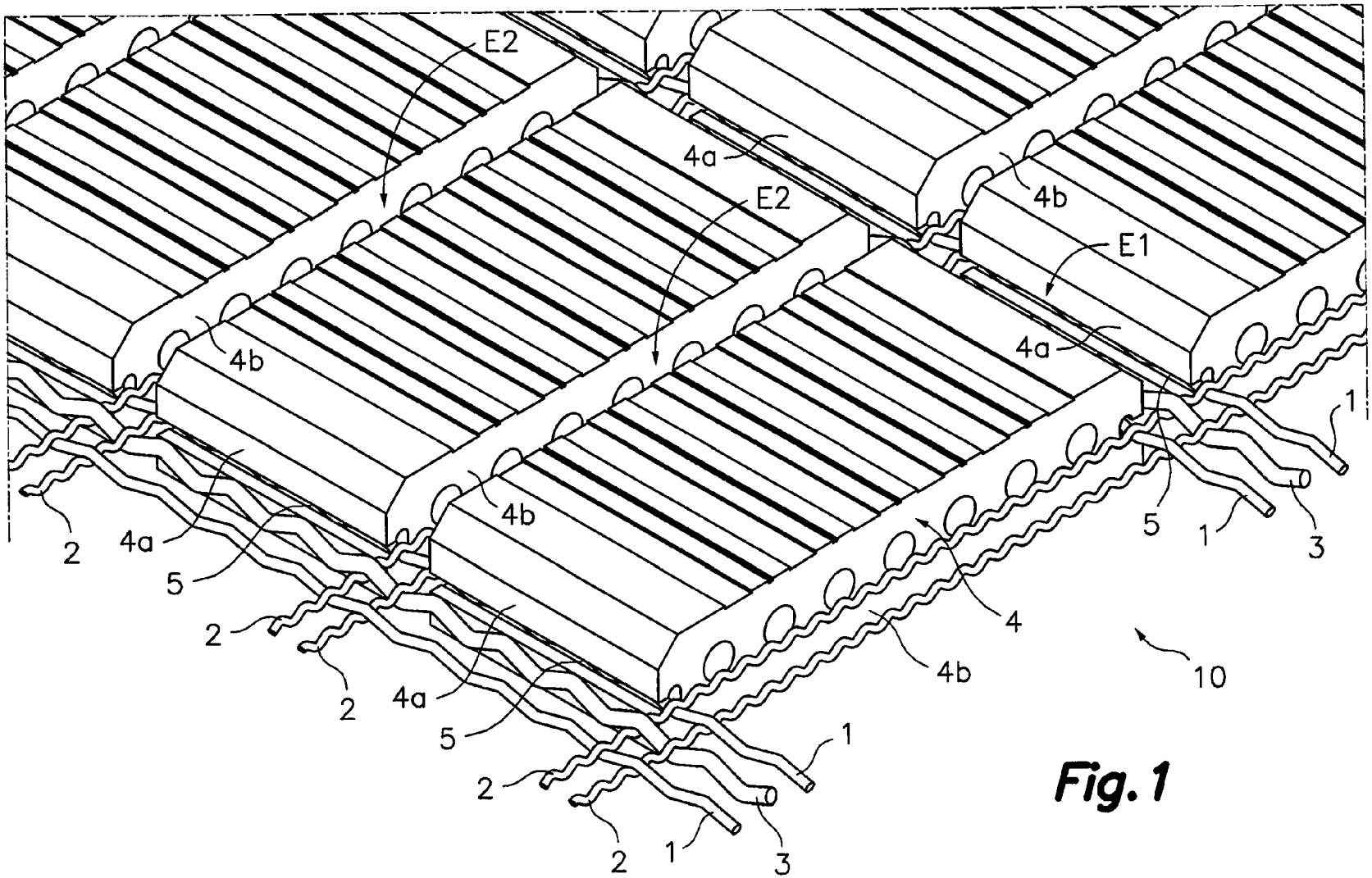
FIG. 1 is a partial isometric view of a flexible brick plate suitable for building bare brick architectural elements according to an embodiment of the present invention.

Referring first to FIG. 1, there is shown a flexible brick plate 10 according to one embodiment of the present invention, which is useful for building bare brick architectural elements, such as roofs, floors or walls, whether planar or arched. The flexible plate 10 is essentially formed by a plurality of flexible interwoven rods 1, 2, 3 forming a mesh, and a plurality of bricks 4 provided with fastening shapes 5 coupled to at least some of said rods 1, 2, 3 in order to retain said bricks 4 in stable positions in said mesh. The bricks 4 are arranged on one of its larger faces and with aligned gaps therebetween.

Figure 2:
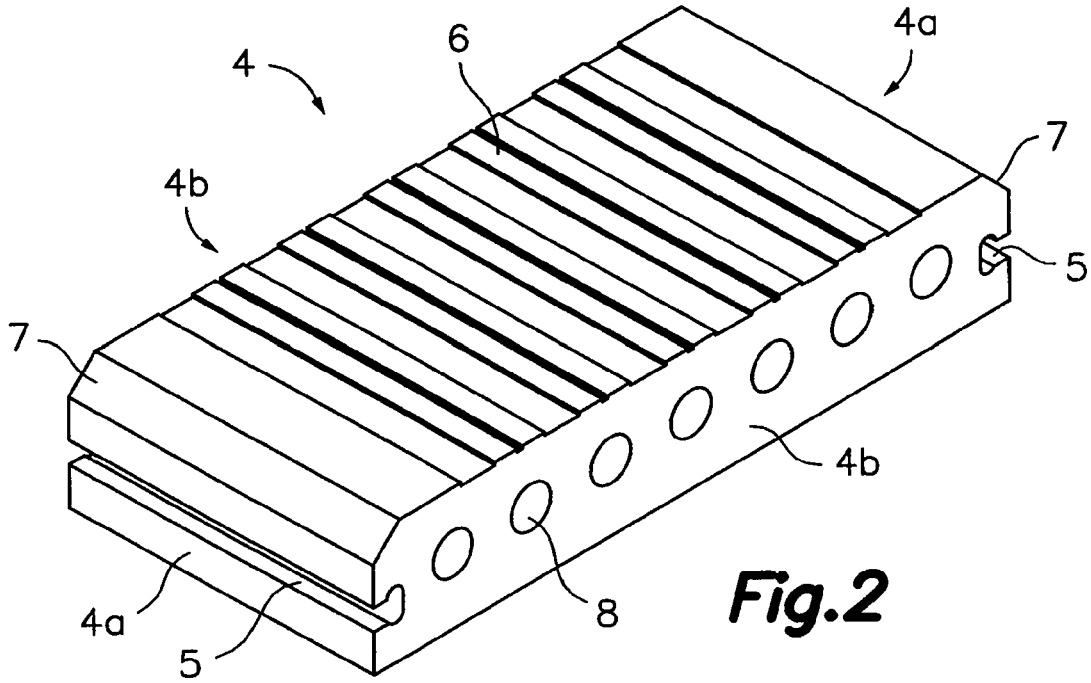
FIG. 2 is an isometric view of a brick which is a component of the flexible brick plate of FIG. 1.

FIG. 2 separately shows one of the bricks 4 that form the flexible plate 10 together with the rods 1, 2, 3. The brick 4 substantially has a prismatic rectangular shape and has a pair of opposite larger faces flanked by a pair of first opposite edges 4*a* and a pair of second opposite edges 4*b* perpendicular to one another. The first edges 4*a* correspond to the shorter dimension of the brick 4 and the second edges 4*b* correspond to the longest dimension of the brick 4. In the position shown in FIG. 2, the upper larger face of the brick 4 is a face provided for being concealed and covered with a layer of binding agent, and has embossments 6 formed therein, whereas the lower face (not shown) is provided for being seen and is completely smooth. Bevels 7 are formed between the larger face provided for being concealed and the first edges 4*a*, said bevels 7 having the function of preventing the edges of adjacent bricks 4 in the mesh from colliding with one another when the flexible plate 10 is wound up in a roll B, as will be explained below. The brick 4 further comprises holes 8 parallel to the first edges 4*a* and which traverse it from one of the second edges 4*b* to the other. Said fastening shapes 5 comprise a pair of channels formed in the first edges 4*a* of the brick 4 and each channel has an inner area communicated with the outside through a slot that is narrower than said inner area.

Figure 3:
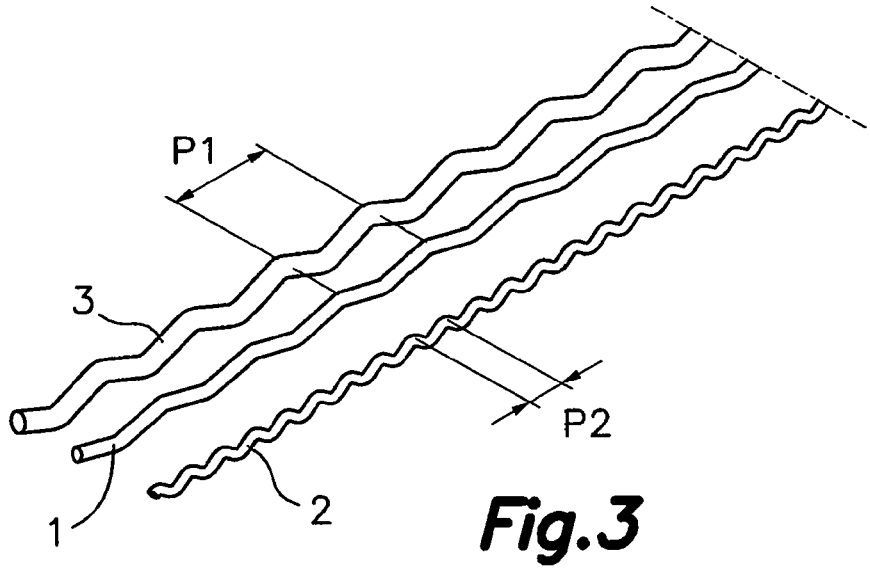
FIG. 3 is a partial isometric view of rods which are components of the flexible brick plate of FIG. 1.

FIG. 3 separately shows a set of rods 1, 2, 3 that form the flexible plate 10 together with the bricks 4. Although for the purposes of the present invention all the rods 1, 2, 3 could be identical, in the illustrated embodiment there are three types of rods with different characteristics according to the function they carry out in the flexible plate 10. A characteristic that is common to the three types of rods 1, 2, 3 is that they are corrugated to immobilize the intersection points thereof in the mesh, according to a well-known technique.

A first type of rods consists of support rods 1 which extend in the flexible plate 10 parallel to the first edges 4*a* of the bricks (FIG. 1). These support rods 1 are inserted in the channels formed by the fastening shapes 5 in the first edges 4*a* of the brick 4. To that end, said inner area of the channels 5 is sized to house said support rod 1 and said slot communicating the channels with the outside is sized to allow the passage of the support rods 1 for the purpose of facilitating the method for manufacturing the flexible plate 10. The support rods 1 are corrugated with a first corrugation pitch P1 (FIG. 3) according to the shortest dimension of the brick 4, i.e., according to the distance between the second edges 4*b*.

A second type of rods comprises positioning rods 2 which extend in the flexible plate 10 parallel to the second edges 4*b* of the bricks (FIG. 1). Said positioning rods 2 are crossed and interwoven with the support rods 1. There are preferably two positioning rods 2 between each two rows of bricks 4. The positioning rods 2 are corrugated with a second corrugation pitch P2 (FIG. 3) according to the longest dimension of the brick 4, or more specifically, according to the distance between the fastening shapes 5.

Thus, the combination of said first corrugation pitch P1 of the support rods 1 and the second corrugation pitch P2 of the positioning rods 2 determines that the positioning rods 2 can maintain the support rods 1 in suitable positions for being inserted in the fastening shapes 5 of the bricks 4 and thereby retaining the bricks 4 in the mesh and at the same time preventing movements of the bricks 4 in the mesh in a first direction parallel to the second edges 4*b* of the bricks 4, i.e., parallel to their longest dimension, and that the support rods 1 can maintain the positioning rods 2 in suitable positions adjacent to the second edges 4*b* of the bricks 4 for preventing the movements of the bricks 4 in the mesh in a second direction parallel to the first edges 4*a* of the bricks 4, i.e., parallel to their shortest dimension. Furthermore, the positions of the support rods 1 determine a first gap E1 (FIG. 1) between said first opposite edges 4*a* of the bricks 4 of the adjacent rows and the positions of the positioning rods 2 determine a second gap E2 (FIG. 1) between the second edges 4*b* of the bricks 4 of the adjacent rows.

A third type of rods comprises reinforcement rods 3 which extend in the flexible plate 10 parallel to the first edges 4*a* of the bricks (FIG. 1), and accordingly, parallel to the support rods 1. The reinforcement rods 3 are corrugated with the same first corrugation pitch P1 as the support rods 1 (FIG. 3). A reinforcement rod 3 is arranged in the mesh, in each of said first gaps E1 between the first opposite edges 4*a* of the bricks 4 of adjacent rows, and all the reinforcement rods 3 are crossed and interwoven with the positioning rods 2. The combination of said first corrugation pitch P1 of the reinforcement rods 3 and the second corrugation pitch P2 of the positioning rods 2 determines that the reinforcement rods 3 are substantially in a central position inside the corresponding gap E1 (see also FIG. 4), separated from the first opposite edges 4*a* of the adjacent bricks 4. Obviously, for the purposes of the present invention there can be more than one reinforcement bar 3 in each first gap E1 in the mesh provided that the reinforcement bars 3 are separated from the first opposite edges 4*a* of the adjacent bricks 4.

As can be seen in FIG. 3, in the illustrated embodiment the thickness of the reinforcement rods 3 is greater than the thickness of the support rods 1, and the thickness of the support rods 1 is greater than the thickness of the positioning rods 2. However, the thicknesses of the rods can be variable according to needs. Advantageously, the material of the support, positioning and reinforcement rods 1, 2, 3 is flexible and elastic enough to allow winding the plate up in a roll B (FIG. 6) substantially without causing any plastic or permanent deformation of the support, positioning and reinforcement rods 1, 2, 3. A material suitable for the rods 1, 2, 3 is steel, and the bricks 4 can preferably be made of a ceramic material, although other natural or synthetic materials are not disregarded.

According to an alternative embodiment (not shown), the fastening shapes of the bricks could be formed in the edges corresponding to the longest dimension of the bricks, in which case the rods herein referred to as "positioning rods" would act as support rods and the rods herein referred to as "support rods" would act as positioning rods. Alternatively, the fastening shapes could be formed in the four edges of the bricks, such that all the rods, except the reinforcement rods, would act as support and positioning rods. These alternative embodiments are less preferred because it would be difficult or impossible to manufacture bricks suitable for them by extrusion, making it necessary to use other more expensive techniques for manufacturing bricks.

Figure 4:
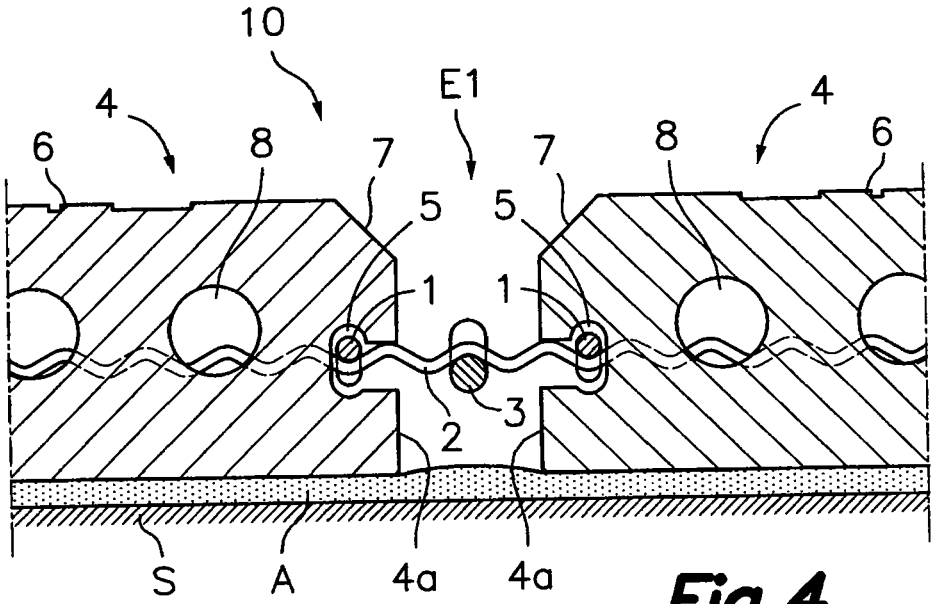
FIG. 4 is a partial cross section view of the flexible brick plate in a working position on a falsework before of the application of a binding agent for building an architectural element.

As is shown in FIG. 4, the flexible plate 10 of the present invention is suitable for being placed with one of its sides against a falsework S, and in this position receiving a binding agent M (FIG. 5) from and on the other one of its sides. Typically, the side of the flexible plate 10 corresponding to the visible face of the bricks 4 is the one that will be applied against the falsework S, and the binding agent M, typically concrete or mortar, will be applied on the side of the flexible plate 10 corresponding to the concealed face of the bricks 4. A padding A, made for example of an elastomeric material, will preferably be placed between the flexible plate 10 and the falsework S, said padding A having the function of sealing the lower part of the first and second gaps E1, E2 between bricks 4 so as to prevent the binding agent M from extending towards the visible face of the bricks.

Figure 5:
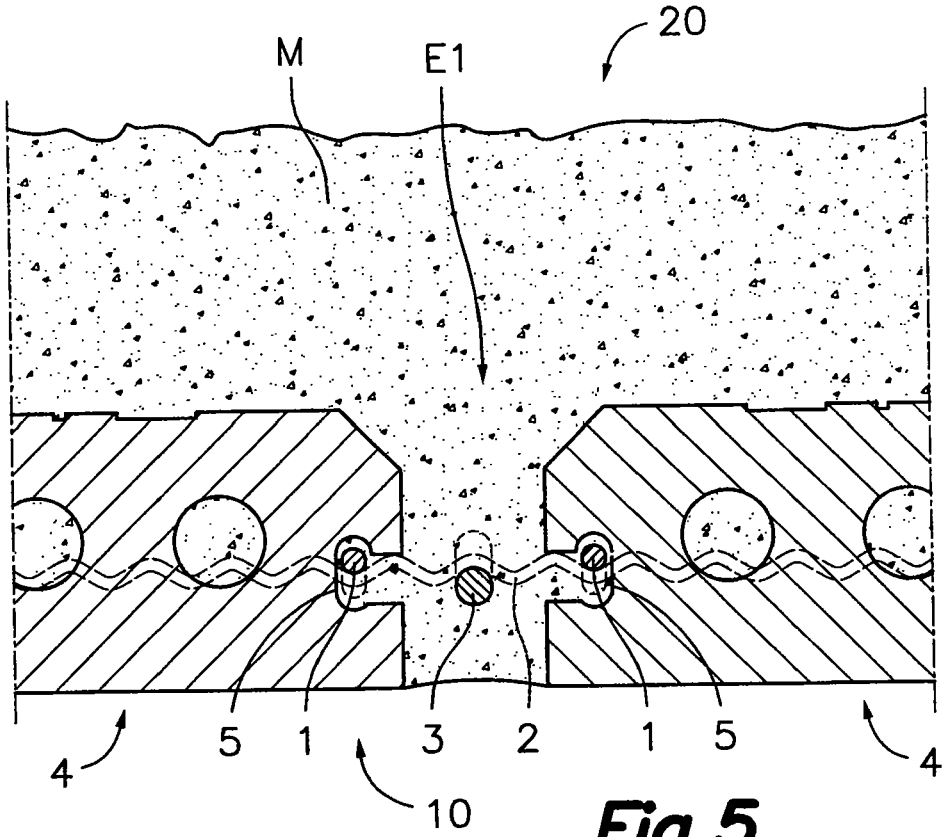
FIG. 5 is a partial cross section view of an architectural element built using the flexible brick plate in cooperation with a binding agent.

FIG. 5 shows an architectural element 20 obtained from the flexible plate 10 of the present invention. In said architectural element 20, the binding agent M applied on the flexible plate 10 has covered the bricks 4 and penetrated in the first and second gaps E1, E2 between bricks 4, in the fastening shapes 5 and in the holes 8 of the bricks, substantially embedding the rods 1, 2, 3. It can occur that the support and positioning rods 1, 2 are not completely embedded in the binding agent M due to their proximity or contact with the bricks 4. In contrast, the fact that the reinforcement rods 3 are separated from the bricks assures that at least these reinforcement rods 3 will be completely embedded in the binding agent M and can be used as the basis for calculating the reinforcement. When the binding agent M has set, the falsework S and the padding A can be removed such that the bare brick architectural element 20 is obtained. The flexible plate of the present invention can be applied to building architectural elements such as floors, walls and roofs, preferably with a bent design, and quite especially reinforced masonry vaulted roofs with their intrados finished with bare bricks.

Figure 6:
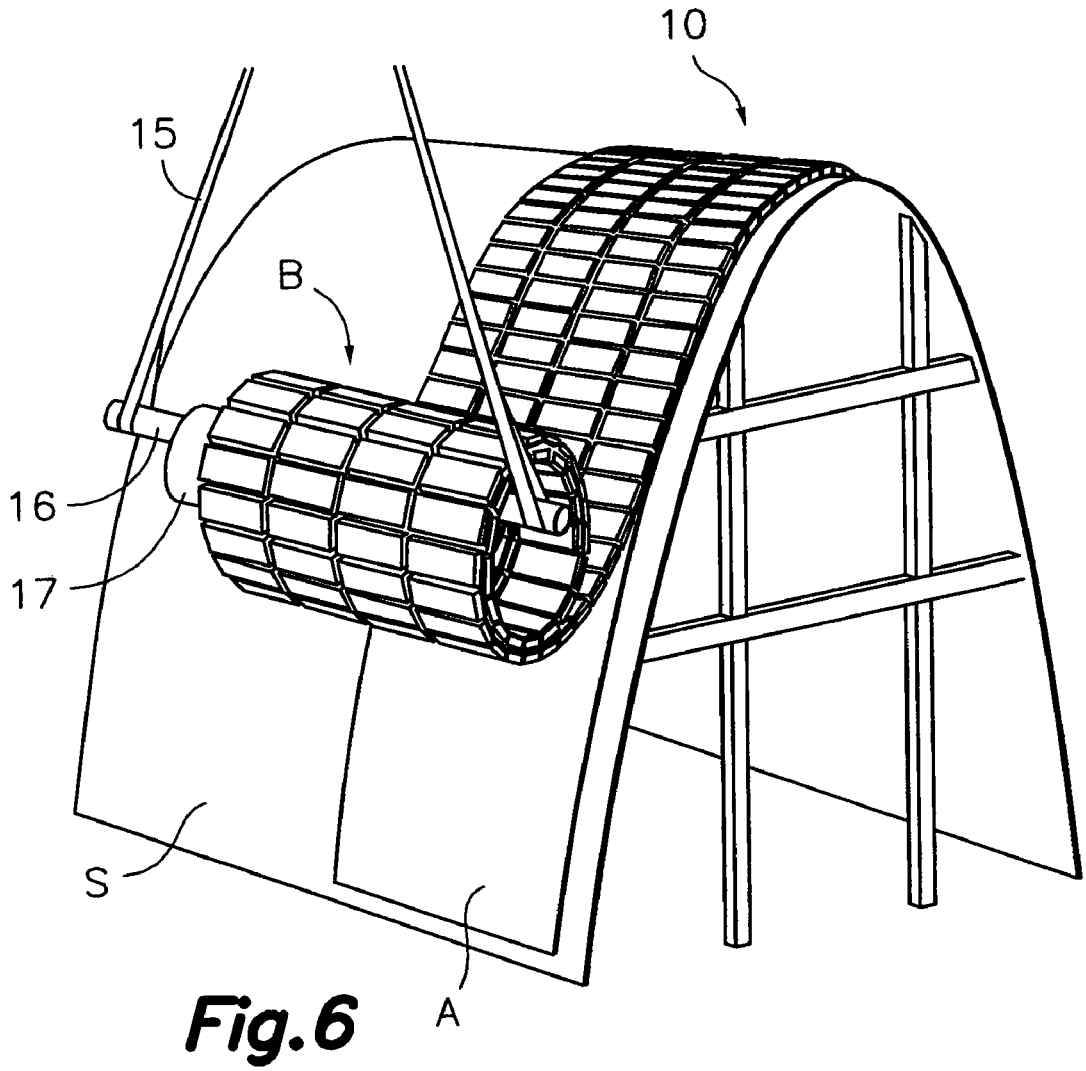
FIG. 6 is a perspective view showing a falsework and a flexible brick plate wound up in a roll that is being extended on said falsework.

FIG. 6 schematically illustrates the process for manufacturing a vault using the flexible plate 10 of the present invention, which has been provided wound up in the form of a roll B. First, the falsework S, which can be extremely lightweight, has been built. The padding A is laid on the falsework S, and the flexible plate 10 is laid on the padding by unrolling the roll B. The roll B is easily handled by means of a crane which supports straps 15 secured to a shaft 16 passing through the inner hollow of the roll B. Said shaft 16 can be any bar or tube stretch with suitable dimensions and strength, and the shaft 16 is preferably inserted in a piece of tube 17 having a larger diameter that acts as a bearing between the shaft 16 and the roll B. When the binding agent M (not shown in FIG. 6) has set, the falsework S can be disassembled and the padding A removed, and both the falsework S and the padding A can be reused.

Figure 7:
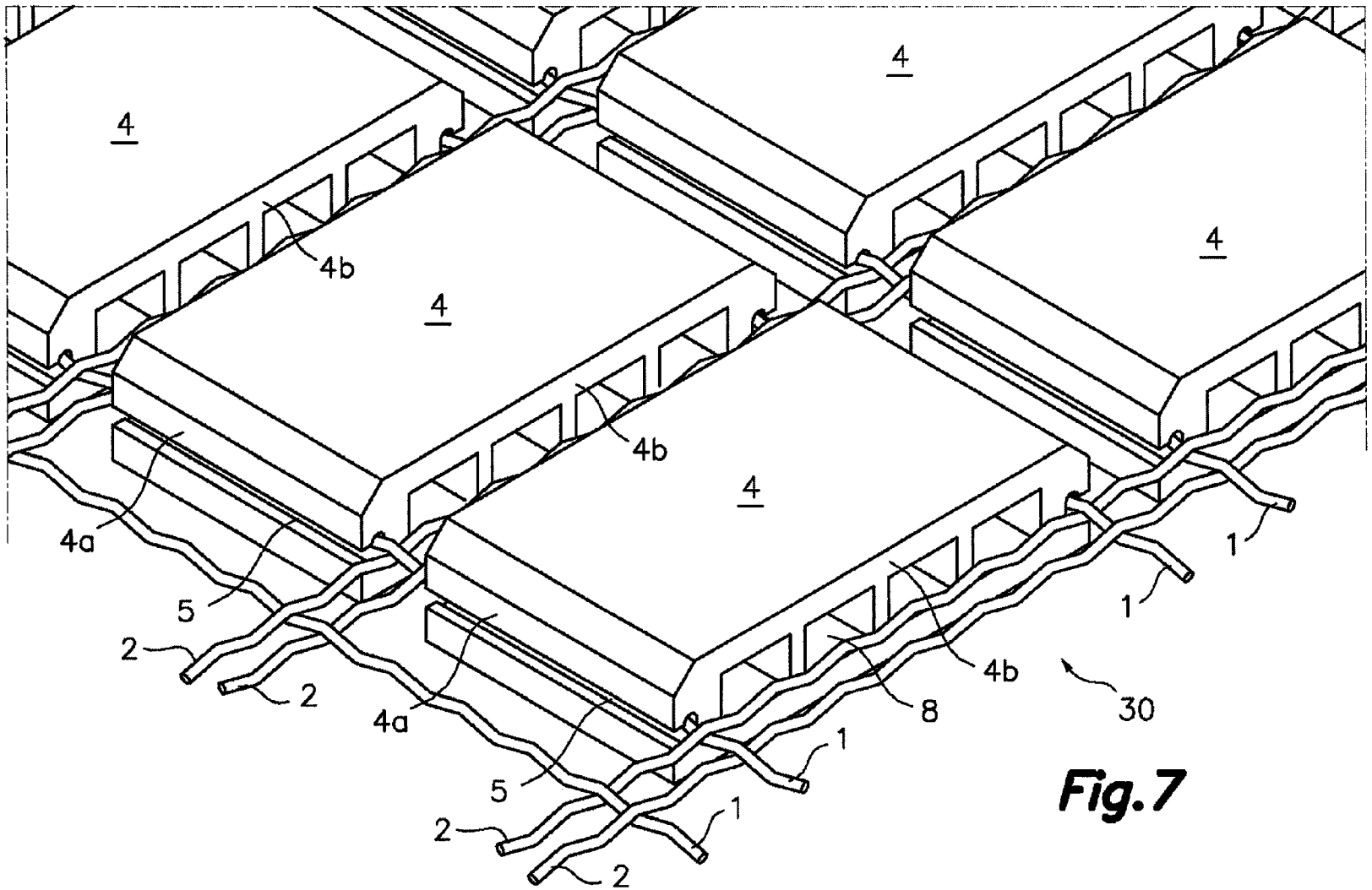
FIG. 7 is a partial isometric view of a flexible brick plate suitable for building bare brick architectural elements without a binding agent according to an alternative embodiment.

Referring now to FIG. 7, there is shown a flexible brick plate 30 according to an alternative embodiment of the present invention, which is useful for building bare brick architectural elements, whether planar or arched, without a binding agent, such as covering of grounds, terrains, walls, vaults and roofs; ballasting of roofs; formation of ventilated walls, lattices, pergolas; and shaded area roofs and/or walls, among others. Similarly to the brick plate 10 described in relation to FIG. 1, the brick plate 30 of FIG. 7 is essentially formed by a plurality of corrugated, flexible interwoven rods 1, 2 forming a mesh, and a plurality of bricks 4 provided with fastening shapes 5 coupled to at least some of said rods 1, 2 in order to retain said bricks 4 in stable positions in said mesh. The bricks 4 are arranged on one of its larger faces and with aligned gaps therebetween.

Given that in the absence of binding agent both the rods 1, 2 and the bricks 4 of the brick plate 30 will be in contact with the surrounding atmosphere when in use, the rods 1, 2 are made of a material resistant to external agents or have a treatment resistant to external agents, and likewise the bricks 4 are made of a material resistant to the external agents or have a treatment resistant to external agents. Furthermore, since the brick plate 30 will be used without a binding agent, such as concrete, mortar or cement puddle, the reinforcement rods are not necessary and accordingly have been omitted, such that only the support rods 1 and the positioning rods 2 are present. In the embodiment of FIG. 7, the support rods 1 and the positioning rods 2 are identical to one another, i.e., they are made of the sane material and have the same diameter and the same corrugation pitch, which contributes to reducing costs, although there is no technical impediment to them being different.

The bricks 4 of the plate 30 of FIG. 7 are substantially orthohedron and have two larger substantially parallel faces, two first rectilinear and mutually parallel opposite edges 4*a* in which channel-shaped fastening shapes 5 are formed, and two second rectilinear, mutually parallel opposite edges 4*b* perpendicular to said first edges 4*a*. The support rods 1 and the positioning rods 2 are orthogonally crossed and interwoven with one another forming the mesh. The support rods 1 are inserted in said fastening shapes 5 of the first edges 4*a* of the bricks 4 to support the bricks 4 and to prevent or limit the movements thereof in a first direction, and the positioning rods 2 are adjacent and eventually in contact with the second edges 4*b* of the bricks 4 to prevent or limit the movements of the bricks 4 in a second direction transverse to the first one. Given that the rods 1, 2 are flexible, the plate can be wound up forming a roll to facilitate its storage, transport and installation. The bricks 4 illustrated in the plate 30 of FIG. 7 have substantially smooth larger faces, although optionally one or both of the larger faces can have embossments, furrows, hollows, protuberances, etc.

A significantly dense brick plate 30, i.e., in which opaque or closed surfaces predominate over the hollows, can be obtained by using, as in the example of FIG. 7, orthohedron bricks 4 and only the support rods 1 and positioning rods 2 necessary for supporting and positioning the bricks 4 and keeping the mesh well secured. In FIG. 7, furthermore, the bricks 4 comprise significantly wide hollows 8 extending from one of the second edges 4*b* to the other, parallel to the first edges 4*a*. These hollows 8 lighten the weight of the bricks and, therefore, make the brick plate 30 more lightweight.

Figure 8:
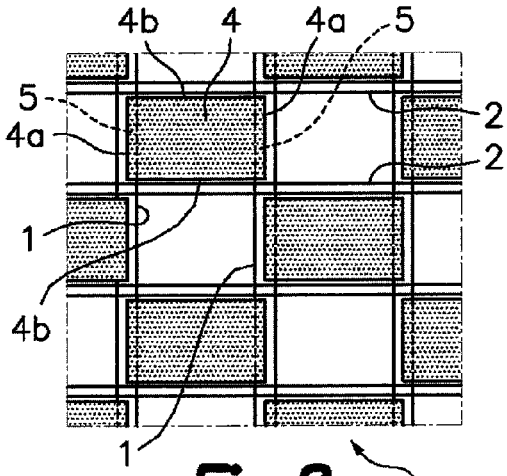
FIGS. 8 to 13 are partial schematic plan views showing several examples of shapes of bricks and arrangement of support and positioning rods to form brick plates according to several variants of the alternative embodiment, in which the bricks are shown shaded for greater clarity.

With reference to FIG. 8, a variant of the alternative embodiment is shown wherein the brick plate comprises a plurality of crossed and interwoven support rods 1 and positioning rods 2, as well as a plurality of bricks 4 coupled by means of their fastening shapes 5 with the support rods 1 and constrained by the support rods 1 and positioning rods 2 in a manner similar to that described above in relation to FIG. 7. The difference is that here, the orthohedron bricks 4 take up only alternating gaps of the mesh, such that the remaining gaps are vacant. A very thin or much less dense brick plate in comparison, for example, with the plate 30 of FIG. 7, is thus obtained.

Figure 9:
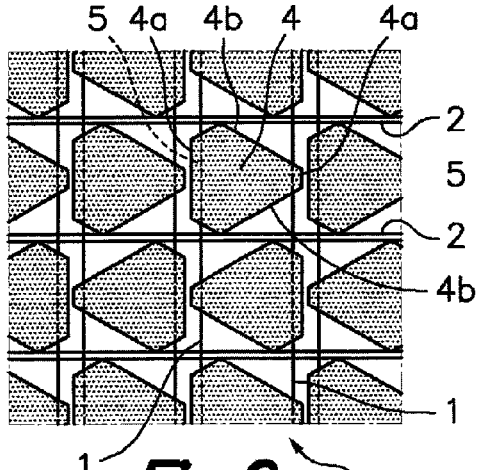

FIG. 9 shows another variant of the alternative embodiment likewise comprising a plurality of crossed and interwoven support rods 1 and positioning rods 2, as well as a plurality of bricks 4 coupled by means of their fastening shapes 5 with the support rods 1 and constrained by the support rods 1 and positioning rods 2, in which obviously the first edges 4*a* of the bricks 4 are mutually parallel although having different lengths. The difference lies in the fact that the second opposite edges 4*b* of the bricks 4 have an interrupted shape and are neither mutually parallel nor perpendicular to the first edges 4*a*. In fact, the positioning rods 2 cooperate only with one vertex of each second edge 4*a* of the bricks 4 to constrain the bricks in the second direction.

Figure 10:
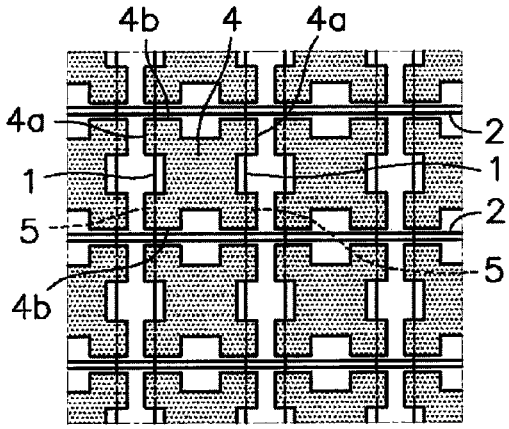

FIG. 10 shows another variant of the alternative embodiment comprising, as is typical, a plurality of crossed and interwoven support rods 1 and positioning rods 2, as well as a plurality of bricks 4 coupled by means of their fastening shapes 5 with the support rods 1 and constrained by the support rods 1 and positioning rods 2. Each of the first edges 4*a* of the bricks 4 has an interrupted shape with two aligned rectilinear portions in which the corresponding fastening shape 5 is formed, and the aligned portions of the two first edges 4*a* are mutually parallel. Similarly, each of the second edges 4*b* of the bricks 4 has an interrupted shape with two aligned rectilinear portions and the aligned portions of the two second edges 4*b* are mutually parallel and perpendicular to the aligned portions of the first edges 4*a*.

Figure 11:
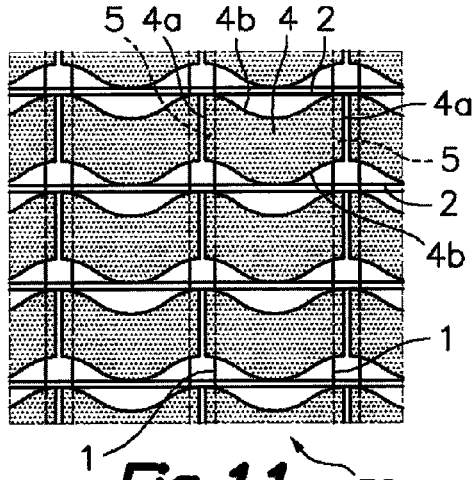

FIG. 11 shows yet another variant of the alternative embodiment comprising a plurality of crossed and interwoven support rods 1 and positioning rods 2, as well as a plurality of bricks 4 coupled by means of their fastening shapes 5 with the support rods 1 and constrained by the support rods 1 and positioning rods 2. The two first edges 4*a* of the bricks 4 are rectilinear and mutually parallel, whereas the two second edges 4*b* are undulated.

Figure 12:
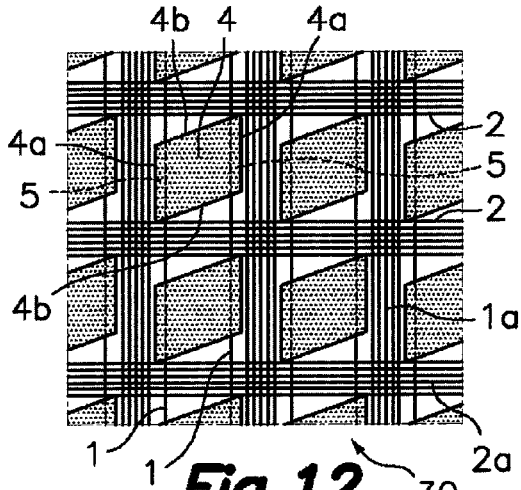

FIG. 12 shows another variant of the alternative embodiment comprising a plurality of crossed and interwoven support rods 1 and positioning rods 2, as well as a plurality of bricks 4 coupled by means of their fastening shapes 5 with the support rods 1 and constrained by the support rods 1 and positioning rods 2. The two first edges 4*a* of the bricks 4 are rectilinear and mutually parallel, and the two second edges 4*b* are also rectilinear and mutually parallel but oblique with respect to the first edges 4*a*. Another particularity of the brick plate shown in FIG. 12 is that it includes a number of first additional corrugated and flexible rods 1*a* parallel to the support rods 1 and a number of second additional corrugated and flexible rods 2*a* parallel to the positioning rods 2, which are crossed and interwoven with one another and with the support rods 1 and positioning rods 2 forming clearly visible mesh portions and providing a thin brick plate. Preferably, for cost-efficiency reasons, the first and second additional rods 1*a*, 2*a* will be identical to the support rods 1 and positioning rods 2, although this is not indispensable.

Figure 13:
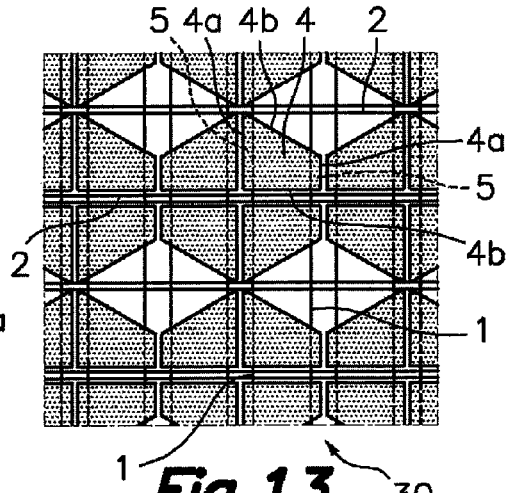

Finally, FIG. 13 shows another variant of the alternative embodiment comprising a plurality of crossed and interwoven support rods 1 and positioning rods 2, as well as a plurality of bricks 4 coupled by means of their fastening shapes 5 with the support rods 1 and constrained by the support rods 1 and positioning rods 2. Here, the first two edges 4*a* of the bricks 4 are rectilinear and mutually parallel, whereas the two second edges 4*b*, though rectilinear, are mutually oblique, one of them being moreover oblique with respect to the first edges 4*a* and the other one perpendicular thereto.

A person skilled in the art will be able to make modifications and variations from the embodiment shown and described without departing from the scope of the present invention as it is defined in the following claims.

The invention claimed is:

1. A flexible brick plate for building architectural elements, comprising a plurality of mutually parallel flexible support rods crossed and interwoven with a plurality of mutually parallel flexible positioning rods forming a mesh, said support rods and positioning rods being corrugated to immobilize the intersection points thereof in the mesh, and plurality of bricks retained in said mesh, wherein each brick has opposite larger faces, first opposite edges, and second opposite edges perpendicular to said first edges, said first opposite edges having channels formed therein, each channel having an inner area communicated with the outside through a slot sized to allow the passage of the support rod, and wherein the support rods are housed in said inner area of said channels.

2. The flexible brick plate according to claim 1, wherein said slot is narrower than said inner area.

3. The flexible brick plate according to claim 1, wherein said positioning rods are shaped and arranged to maintain the support rods in suitable positions in order to retain the bricks in the mesh and leave a first separating gap between said first opposite edges of adjacent bricks.

4. The flexible brick plate according to claim 3, wherein the positioning rods are perpendicular to the support rods and immobilize the bricks in a direction parallel to the support rods.

5. The flexible brick plate according to claim 4, wherein at least one reinforcement rod parallel to the support rods is arranged in each of said first gaps between the first opposite edges of the adjacent bricks, said reinforcement rods being crossed and interwoven with the positioning rods.

6. The flexible brick plate according to claim 4, wherein the positioning rods are arranged to leave a second gap between said second edges of adjacent bricks.

7. The flexible brick plate according to claim 6, wherein the support rods or the support rods and reinforcement rods arranged parallel thereto in the mesh are corrugated with a first corrugation pitch according to a first dimension of the brick parallel to said first opposite edges and the positioning rods are corrugated with a second corrugation pitch according to a second dimension of the brick parallel to said second opposite edges.

8. The flexible brick plate according to claim 7, wherein the thickness of the reinforcement rods is greater than the thickness of the support rods, and the thickness of the support rods is greater than the thickness of the positioning rods.

9. The flexible brick plate according to claim 1, wherein the material of the support rods, positioning rods and reinforcement rods is flexible and elastic enough to allow winding the plate up in a roll substantially without causing any plastic or permanent deformation of the support, positioning and reinforcement rods.

10. The flexible brick plate according to claim 9, wherein said material of the rods is steel.

11. The flexible brick plate according to claim 1, wherein the bricks are of a ceramic material.

12. The flexible brick plate according to claim 1, wherein said plurality of corrugated flexible interwoven rods are made of a material resistant to external agents or have a treatment resistant to external agents, and said plurality of bricks are made of a material resistant to external agents or have a treatment resistant to external agents.

13. The flexible brick plate according to claim 1, wherein the first opposite edges of the bricks are mutually parallel and each one has a rectilinear portion or several aligned rectilinear portions provided with the fastening shape.

14. The flexible brick plate according to claim 1, wherein the second opposite edges of the bricks have a shape selected from the group consisting of: second rectilinear edges, mutually parallel and perpendicular to the first edges; second rectilinear edges, mutually parallel and oblique to the first edges; second rectilinear mutually oblique edges; second interrupted edges; and second undulated edges.

15. The flexible brick plate according to claim 1, wherein the bricks are made of a material selected from the group consisting of: ceramic material; plastic material; elastomeric material; wood; metal; glass; and composite material.

16. The flexible brick plate according to claim 1, wherein the support rods and the positioning rods are made of a material selected from the group consisting of: stainless steel; galvanized steel, painted steel; plasticized steel; aluminum; plastic material; and plastic material reinforced with fibers.

17. The flexible brick plate according to claim 4, wherein the support rods and the positioning rods are identical.

18. The flexible brick plate according to claim 1, wherein the first opposite edges are shorter than said second opposite edges, and the positioning rods are adjacent to the second opposite edges.

* * * * *